US008961749B2

(12) United States Patent
Despinasse et al.

(10) Patent No.: US 8,961,749 B2
(45) Date of Patent: Feb. 24, 2015

(54) ELECTRICAL CONNECTION DEVICE, FOR CONNECTING BETWEEN TWO SUCCESSIVE CELLS OF A SERIES OF CELLS FOR THE PRODUCTION OF ALUMINIUM

(75) Inventors: Serge Despinasse, Foncouverte-la-Toussuire (FR); Yves Rochet, Saint Jean de Maurienne (FR); Sandra Berthe, Saint Jean de Maurienne (FR)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 0 days.

(21) Appl. No.: 13/823,269

(22) PCT Filed: Sep. 6, 2011

(86) PCT No.: PCT/FR2011/000491

§ 371 (c)(1), (2), (4) Date: Mar. 14, 2013

(87) PCT Pub. No.: WO2012/035212

PCT Pub. Date: Mar. 22, 2012

(65) Prior Publication Data

US 2013/0168218 A1 Jul. 4, 2013

(30) Foreign Application Priority Data

Sep. 17, 2010 (FR) ..... 10 03695

(51) Int. Cl.

| | |
|---|---|
| ***C25C 7/00*** | (2006.01) |
| ***C25C 7/06*** | (2006.01) |
| ***H01H 1/58*** | (2006.01) |
| ***C25C 3/16*** | (2006.01) |

(52) U.S. Cl.

CPC ..... *H01H 1/5866* (2013.01); *C25C 3/16* (2013.01); *C25C 7/06* (2013.01)

USPC ..... 204/244; 204/193; 204/194; 204/242; 205/374

(58) Field of Classification Search

CPC ..... C25C 7/005; C25C 7/06; C25C 7/00

USPC ..... 204/193, 194, 242, 244; 205/374

See application file for complete search history.

(56) References Cited

U.S. PATENT DOCUMENTS 4,713,161 A 12/1987 Chaffy et al.
5,660,713 A * 8/1997 Pillet ..... 205/516

FOREIGN PATENT DOCUMENTS

EP 0204647 A1 12/1986
EP 2080820 A1 7/2009

OTHER PUBLICATIONS

International Search Report mailed Oct. 21, 2011 (PCT/FR2011/000491); ISA/EP.

*Primary Examiner* — Zulmariam Mendez
(74) *Attorney, Agent, or Firm* — Banner & Witcoff, Ltd.

(57) ABSTRACT

The electrical connection device connecting the cells in series comprises:

a first conductor (16) connected to the cathode assembly of cell (N−1) and to the anode frame of cell (N), having a portion (19) located between said pots (N−1) and (N) in which the current (I) flows in the direction of the alignment axis (x) of the pots;

a second conductor (24) connected to the cathode assembly of cell (N) and to the anode frame of cell (N+1), having a portion (23) located between said pots (N−1) and (N) in which the current flows away from the axis.

short-circuiting wedges (20, 21) housed between said portions (19, 23) of said conductors (16, 24);

a third conductor (27) to balance the current flowing through the wedges.

10 Claims, 3 Drawing Sheets

ELECTRICAL CONNECTION DEVICE, FOR CONNECTING BETWEEN TWO SUCCESSIVE CELLS OF A SERIES OF CELLS FOR THE PRODUCTION OF ALUMINIUM

CROSS-REFERENCE TO RELATED APPLICATIONS

The present application is a U.S. National Phase filing of International Application No. PCT/FR2011/000491, filed on Sep. 6, 2011, designating the United States of America and claiming priority to French patent application Ser. No. 10/03695, filed Sep. 17, 2010, and the present application claims priority to and the benefit of all the above-identified applications, which are incorporated by reference herein in their entireties.

FIELD OF THE INVENTION

The present invention relates to an electrical connection device between two successive cells (N−1, N) of a series of cells for the production of aluminum using the Hall-Héroult process. The invention also relates to a process for bypassing a cell (N) belonging to such a series of cells by means of said electrical connection device.

BACKGROUND

Metallic aluminum is produced industrially by electrolysis of alumina in solution in an electrolytic bath primarily made up of cryolite, using the Hall-Héroult process. The electrolytic bath is contained in a pot of an electrolytic cell, comprising a steel shell coated on the inside with refractory and/or insulating materials, at the bottom of which a cathode assembly is located.

Anodes, typically made of carbonaceous material, are partially immersed in the electrolytic bath. Each anode is provided with a metal stem designed to connect it electrically and mechanically to an anode frame that is mobile in relation to a gantry fixed above the electrolytic cell.

A plant for the production of aluminum includes a great number of cells, typically one or more hundred, aligned along an axis. An electrical connection device including an array of electrical conductors connects the cathode assembly of cell (N−1) in series to the anode frame of cell (N) located immediately downstream, in the direction of current flow. The ends of the conductors, at the beginning and end of the series of cells, are connected to the positive and negative outputs of an electrical sub-station for rectification and regulation.

The current passing through the successive cells is very high, typically about 200,000 to 500,000 A. Because of this, the array of electrical conductors is designed so that the effects of the large magnetic fields generated compensate each other, so that the problems caused by these magnetic fields (bending of the upper surface of the molten metal in the pot, instabilities, etc.) are reduced.

Because of wear caused by the operation of a cell (N), the pot must be periodically repaired or replaced. In order for the other cells of the series to continue to produce, the cell (N) under consideration is bypassed, so that the current can pass directly from cell (N−1) to cell (N+1), for the time it takes to replace the pot of cell (N).

For this purpose, the practice of placing short-circuiting wedges between a first conductor, connected to the cathode assembly of cell (N−1), and a second conductor, connected to the cathode assembly of cell (N), is known. Because of this the current flows from the cathode assembly of cell (N−1) to the cathode assembly of cell (N), without going through the anode frame of cell (N), and is then sent to the anode frame of cell (N+1).

Because of the very high current flowing through the conductors, it is generally necessary to use at least two wedges in parallel, so that each wedge receives only part of the total current running through the conductors.

The problem encountered is that the layout of the conductors is restricted for reasons of magnetic field compensation, as indicated above, but also of spatial requirements.

One therefore generally has a conductor layout in which:

the first conductor has a portion located between said pots (N−1) and (N) in which the current flows towards the alignment axis of the pots;

the second conductor has a portion located between said pots (N−1) and (N) and in which the current flows away from the alignment axis of the pots;

said portions of the first and second conductors being substantially parallel with each other.

In order to bypass cell (N), a first wedge and a second wedge are interposed between said portions of the first and second conductors, the second wedge being located more towards the alignment axis of the cells. Because of this, two paths of current flow from the first conductor to the second conductor are created, namely a first path through the first wedge and a second path through the second wedge. Due to the opposite direction of flow in the first and second conductors, the two paths have different lengths. Specifically, the second path is longer than the first, and therefore has a higher electrical resistance (due to the similarity of components, i.e. the wedges and conductors).

The result is a significant imbalance between the currents flowing through the wedges. For example, the first wedge may have up to 70% of the total current, and the second wedge only 30%. This is not desirable. On the one hand, the first wedge may deteriorate prematurely. On the other hand, the current imbalance may lead to a limitation of the current in the first wedge, and under-utilization of current capacity in the second wedge, this thereby limiting the overall current capability of the bypassing assembly.

BRIEF SUMMARY

The present invention seeks to overcome the drawbacks mentioned above by providing an electrical connection device between two successive cells that allows a better electrical balance when bypassing a cell, without creating any sensitive magnetic imbalance, and taking into account drastic spatial restrictions.

To this end, the invention relates to an electrical connection device between two successive cells (N−1, N) of a sequence of cells for the production of aluminum by the Hall-Héroult process, the cells being aligned along an axis, each cell comprising an electrolytic cell containing a cathode assembly and an anode frame bearing anodes, the electrical connection device comprising an array of electrical conductors connecting in series the cathode assembly of cell (N−1) to the anode frame of cell (N) located immediately downstream, the array of electrical conductors comprising at least:

a first conductor connected to the cathode assembly of cell (N−1) and the anode frame of cell (N), said first conductor having a portion located between said pots (N−1) and (N) in which the current flows in the direction of the alignment axis of the pots;

a second conductor connected to the cathode assembly of cell (N) and the anode frame of cell (N+1) immediately downstream, said second conductor having a portion located between pots (N−1) and (N) in which the current flows away from the alignment axis of the pots, said portions of the first and second conductors being substantially parallel to each other;

at least two housings to receive a short-circuiting wedge.

According to a general definition of the invention, the array of conductors further comprises a third conductor for current balancing which extends substantially parallel to said portions, said third conductor being electrically connected to said portion of the first conductor or second conductor, the two housings for receiving a wedge being arranged between said third conductor and said portion of the second conductor, or first conductor respectively.

According to an advantageous embodiment of the invention, the at least two housings for receiving the short-circuiting wedge are arranged between said portions of the first and second conductors and the third conductor for balancing the current is located between said portions of the first and second conductors.

The third conductor is advantageously arranged so that when the short-circuiting wedges are inserted into the housings, the current flowing in said third conductor flows in the opposite direction of current flow in said portion of the first conductor, or the second conductor respectively, to which the third conductor is connected.

Therefore, by means of the invention, when cell (N) is bypassed, we get the electrical connection, through the wedges between two parallel conductors in which current flows in the same direction, namely: the third conductor and said portion of the second conductor, or the third conductor and said portion of the first conductor respectively.

In this way, two paths of current flow have been created that are substantially the same length and have substantially identical components. These two paths therefore have substantially the same resistance giving a current balance between the two wedges.

Typically, the first conductor is a conductor to bypass cell (N−1), and/or the second conductor is a conductor to bypass cell (N).

The connection device may also include an insulating element placed between the third conductor and said portion of the first conductor, or the second conductor, to which the third conductor is connected respectively. This insulating part prevents bending of the conductors that could lead to unwanted short circuits.

According to one possible embodiment, the pots of the cells are substantially rectangular and arranged perpendicular to the axis of cell alignment, said portions of the first and second conductors extending substantially parallel to the long sides of the pots.

Advantageously, at least one housing for receiving a short-circuiting wedge may have a tilted face, seen in a plane orthogonal to the direction in which said portions extend from the first and second conductors, so that the housing has a converging shape in the direction of insertion of a wedge.

The connection device may include, in each half-space separated by a vertical plane through the axis of cell alignment, a set of two housings for receiving a wedge, located near a side edge of the pot, and an additional housing for receiving at least one wedge located between said set of two housings and the axis of cell alignment.

In practice, the current is bypassed by the sets of two wedges. The main function of these equipotential wedges, located closest to the alignment axis, is to balance the current.

According to a second aspect, the invention relates to a method for bypassing a cell (N) belonging to a series of cells for the production of aluminum using the Hall-Héroult process, through an electrical connection device as previously described, in which method a first and a second wedge are inserted into the housing for receiving a short-circuiting wedge arranged between said third conductor and said portion of the second conductor, or the first conductor respectively.

BRIEF DESCRIPTION OF THE DRAWINGS

Below are described, as nonrestrictive examples, several possible embodiments of the invention, with reference to the appended figures.

DETAILED DESCRIPTION

Figure 1:
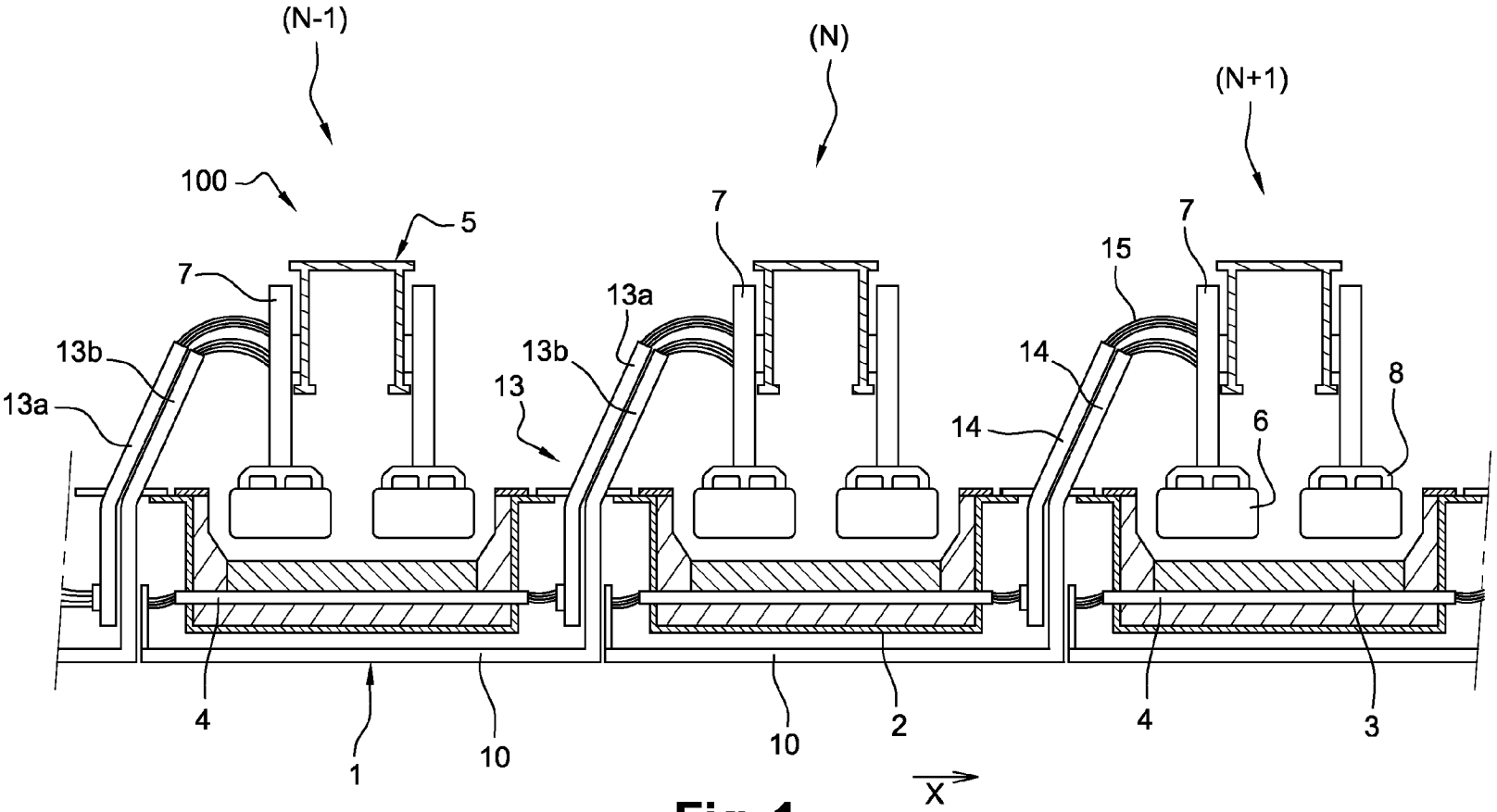
FIG. 1 is a schematic section of a series of successive electrolytic cells (N−1), (N) (N+1) electrically connected in series.
Figure 2:
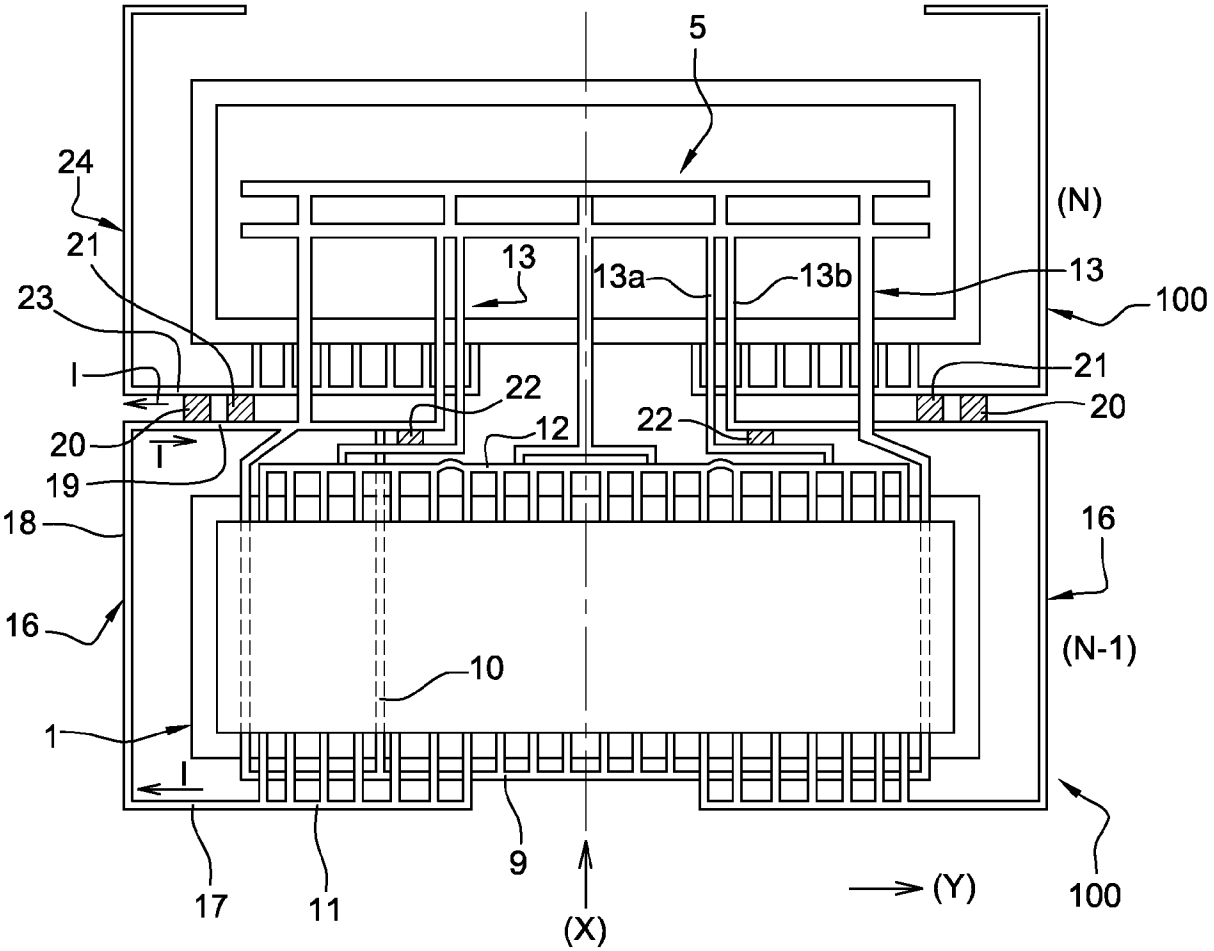
Fig. 2 Prior Art
FIG. 2 is a partial top view of cells (N−1) and (N) in FIG. 1, showing, in a simplified way, the array of conductors between cells, and showing the arrangement of short-circuiting wedges of prior art.

As shown in FIGS. 1 and 2, an electrolytic cell 100 comprises a pot 1 of generally rectangular shape with two short sides and two long sides. Axis (x) is defined as being parallel to the short sides and substantially median to pot 1, and direction (y) as the horizontal direction orthogonal to (x).

Pot 1 typically comprises a metal pot shell 2 lined with refractory materials (not shown) and cathode assemblies which are oriented substantially parallel to (x) each having a carbonaceous material cathode 3 connected to a busbar 4.

Cell 100 also includes an anode assembly comprising an anode frame 5 oriented along (y) and located above pot 1. On the anode frame 5 are fixed stems 7, each provided with a multipode 8 attached to a carbon material anode 6.

When in operation, pot 1 comprises a bed of liquid aluminum, a bed of liquid bath and a cover containing solid bath and alumina.

A number of cells 100 are aligned successively along axis (x) as seen in FIGS. 1 and 2, the short sides of the pots forming two substantially parallel straight lines. FIG. 1 shows three successive electrolysis cells (N−1), (N) (N+1), while FIG. 2 shows two successive electrolysis cells (N−1), (N).

Cells 100 are electrically connected in series. To this end, an array of conductors is provided connecting in series the cathode assembly of an upstream cell to the anode frame of the cell located immediately downstream. The terms "upstream" and "downstream" are defined in the direction of current flow, which is also the direction of the axis (x). The current flowing through the series of cells has a very high intensity I, typically of the order of 200,000 to 500,000 A.

The array of conductors is designed so that the magnetic field generated, at the intensities under consideration, is consistent with stable operation of the pot.

For a given cell 100, the array of conductors comprises, briefly:

an upstream cathode collector 9 connected to some of the busbars 4 and to conductors 10 passing under pot 1;

another upstream cathode collector 11 connected to the other busbars 4 and extended by a conductor to bypass pot 1 of this cell (N−1);

at least one downstream cathode collector 12 connected to at least some of the busbars 4.

The electrical connection between the cathode collectors 9, 11, 12 of pot (N−1) and the anode frame 5 of pot (N) is provided by uprights 13, here four in number. Some may be double uprights and include a first leg 13*a* directly connected to a downstream cathode collector 12 and a second leg 13*b* connected to an upstream cathode collector 9, 11 by a conductor 10 passing under the pot or a conductor to bypass pot 1 (see FIG. 2).

Each conductor may include a rigid portion 14 in the form of a metal bar, typically an aluminum bar, and a flexible part 15 to allow for the production of bent portions.

Note that to simplify the drawings and facilitate understanding of the invention, the bypass conductors are not shown in FIG. 1. In addition, in FIG. 2, the array of conductors of cell (N) is only partially represented as far as connections between the cathode assemblies are concerned.

As shown in FIG. 2, a given cell includes a conductor to bypass each of the short sides of pot 1, arranged in a substantially symmetrical way about axis (x). This bypass conductor receives most, typically from 70 to 95%, of the current leaving the cathode assembly of cell (N−1) N when cell N is bypassed.

Each bypass conductor and typically the bypass conductor of cell 16 (N−1) includes:

an upstream portion 17 substantially parallel to (y), which is located between cell (N−2) and cell (N−1) in which the current flows away from axis (x);

a portion 18 substantially parallel to (x) and along the short side of cell (N−1), in which the current flows in the direction of axis (x);

and a downstream portion 19 substantially parallel to (y), which is located between cell (N−1) and cell (N) in which the current flows in the direction of axis (x).

When it is desired to bypass pot (N), several wedges are placed to allow the current to flow directly from the cathode assembly of cell (N−1) to the anode assembly of cell (N+1). The wedges are inserted into appropriate housings between the conductors under consideration.

FIG. 2 shows, on each side of axis (x):

a set of two side wedges, namely a first wedge 20 and a second wedge 21 closer to axis (x) than the first wedge 20. These wedges 20, 21 are located between the downstream portion 19 of the bypass conductor 16 of cell (N−1) and the upstream portion 23 of the bypass conductor 24 of cell (N);

an equipotential wedge 22 located closer to axis (x) than the two wedges 20, 21.

We are particularly interested in the sets of two side wedges, i.e., the first wedge 20 and the second wedge 21.

Figure 3:
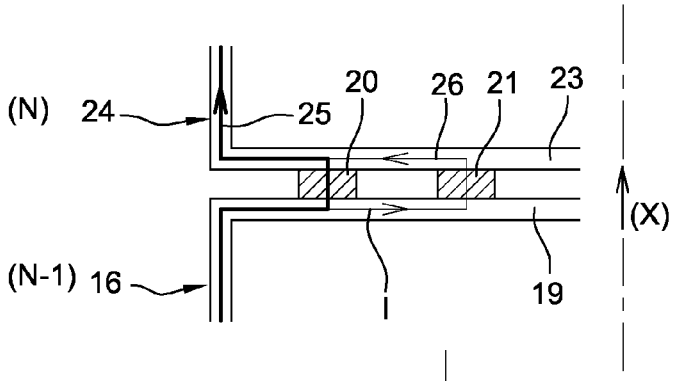
Fig. 3 Prior Art
FIG. 3 is a schematic representation of the array of electrical conductors located in the vicinity of the two wedges, according to prior art.

As shown in FIGS. 2 and 3, in prior art, wedges 20, 21 are interposed directly between the downstream portion 19 of the bypass conductor 16 of cell (N−1) and the upstream portion 23 of the bypass conductor 24 of cell (N).

This creates a first path 25 of current flow I from the first conductor 16 to the second conductor 24 via the first wedge 20 (shown as a thick line in FIG. 3) and a second path 26 of current flow I from the first conductor 16 to the second conductor 24 via the second wedge 21 (shown as a thin line in FIG. 3). As shown in FIG. 3, due to the opposite flow direction of the current in portions 19 and 23, the second path 26 is longer than the first path 25, resulting in a higher electrical resistance. The electrical current flowing through the first wedge 20 is therefore greater than that flowing through the second wedge 21, which has the drawbacks mentioned above.

Figure 4:
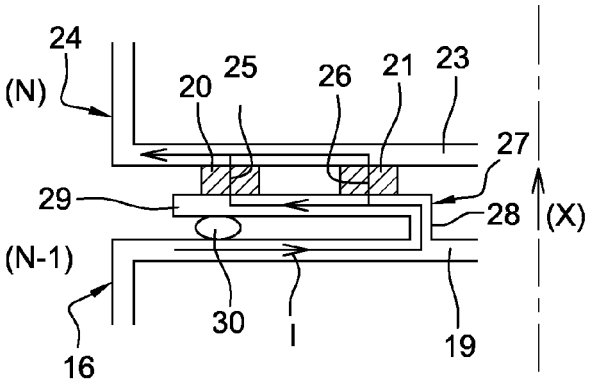
FIG. 4 is a schematic representation of the part of the array of electrical conductors located in the vicinity of the two wedges, according to a first embodiment of the invention.
Figure 5:
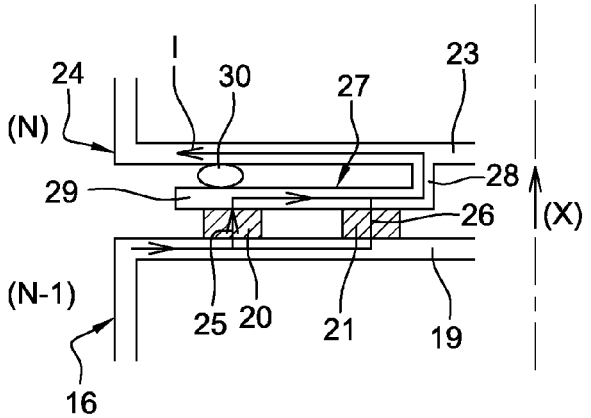
FIG. 5 is a schematic representation of the part of the array of electrical conductors located in the vicinity of the two wedges, according to a second embodiment of the invention.

A first and a second embodiment of the electrical connection device according to the invention are illustrated in FIGS. 4 and 5 respectively In a first embodiment, shown in FIG. 4, a third conductor 27 is provided to balance the current I. The third conductor 27 is located between the downstream portion 19 of the bypass conductor 16 of cell (N−1) and the upstream portion 23 of the bypass conductor 24 of cell (N) and extends substantially parallel to said portions 19, 23. This third conductor 27 has a first end 28 electrically connected to the downstream portion 19 of the bypass conductor 16 of cell (N−1) and a free second end 29, further from axis (x) than the first end 28.

Therefore, as shown in FIG. 4, current I flows through the third conductor 27 in the opposite direction to that of current flow in portion 19 and in the same direction as in portion 23.

Wedges 20, 21 are interposed between the third conductor 27 and the upstream portion 23 of the bypass conductor 24 of cell (N), i.e. in two parallel conductors in which current flows in the same direction, away from axis (x).

Because of this, two paths of current flow I from the first conductor 16 to the second conductor 24 are created—a first path 25 via the first wedge 20 and a second path 26 via the second wedge 21—which have substantially the same length, and therefore substantially the same resistance, thereby obtaining current balancing between the two wedges.

Advantageously, an insulating element 30 is placed between the third conductor 27 and the downstream portion 19 of the bypass conductor 16 of cell (N−1) in order to prevent unwanted short circuits.

Thanks to the invention, it is considered possible to obtain a throughput of about 55% of the current in the first wedge 20 and about 45% of the current in the second wedge 21.

A second embodiment of the invention is shown in FIG. 5. The third conductor 27 for balancing current I is also located between the downstream portion 19 of the bypass conductor 16 of the cell (N−1) and the upstream portion 23 of the bypass conductor 24 of cell (N) and s' extends substantially parallel to said portions 19, 23.

In this second embodiment, the third conductor 27 has a first end 28 electrically connected to the upstream portion 23 of the bypass conductor 24 of cell (N) and a free second end 29, further from axis (x) than the first end 28.

Therefore, as shown in FIG. 5, current I flows through the third conductor 27 in the opposite direction to that of current flow in portion 23 and in the same direction as in portion 19.

Wedges 20, 21 are interposed between the third conductor 27 and the downstream portion 19 of the bypass conductor 16 of cell (N−1), i.e. in two parallel conductors in which current flows in the same direction, towards axis (x).

Because of this, two paths of current flow I from the first conductor 16 to the second conductor 24 are created—a first path 25 via the first wedge 20 and a second path 26 via the second wedge 21—which have substantially the same length, and therefore substantially the same resistance, thereby obtaining current balancing between the two wedges.

Advantageously, an insulating element 30 is placed between the third conductor 27 and the upstream portion 23 of the bypass conductor 24 of cell (N) in order to prevent unwanted short circuits.

Figure 6:
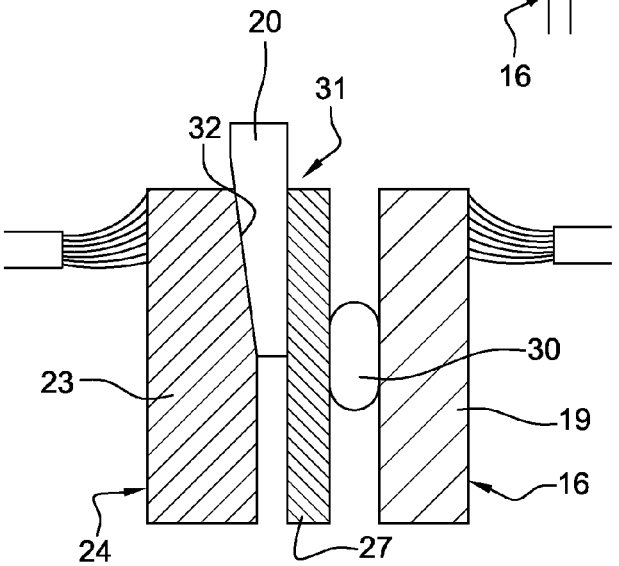
FIG. 6 is a sectional view of the conductors, transversely to these, in the area of the housing for receiving a wedge.

Each of the wedges 20, 21 is placed in a housing 31 located between the two conductors electrically connected to it. This housing 31 is formed in the space between said conductors. For example, FIG. 6 shows the conductors in FIG. 4 as a cross section transversal to them. As shown in this figure, according to an advantageous embodiment of the invention, housing 31 has a tilted face 32 so that housing 31 has a converging shape facilitating insertion of a wedge 20.

It goes without saying that the invention is not limited to the embodiments described above by way of examples, but encompasses all embodiment variants. Other housing assemblies for receiving short-circuiting wedges and short-circuiting wedges may be provided between the pots in relation to what is described with reference to FIG. 2. Also, short-circuiting assemblies may include more than two housings, particularly three.

The invention claimed is:

1. Electrical connection device between first and second successive cells of a sequence of cells for the production of aluminum by a Hall-Héroult process, the sequence of cells being aligned along an axis, each cell comprising an electrolytic pot containing a cathode assembly and an anode frame bearing anodes, the electrical connection device comprising an array of electrical conductors connecting in series the cathode assembly of the first cell to the anode frame of the second cell located immediately downstream, the array of electrical conductors comprising at least:

a first conductor connected to the cathode assembly of the first cell and to the anode frame of the second cell, said first conductor having a portion located between the first and second cells in which the current flows toward the alignment axis of the sequence of cells;

a second conductor connected to the cathode assembly of the second cell and the anode frame of a third cell immediately downstream of the second cell, said second conductor having a portion located between the first and second cells in which current flows away from the alignment axis of the sequence of cells, said portions of the first and second conductors being substantially parallel to each other; and at least two housings to receive a short-circuiting wedge, characterized in that the array of conductors further comprises a third conductor for current balancing which extends substantially parallel to said portions, said third conductor being electrically connected to said portion of the first conductor or second conductor, the two housings for receiving a wedge being arranged between said third conductor and said portion of the second conductor, or first conductor respectively.

2. The device according to claim 1, characterized in that the at least two housings for receiving short-circuiting wedges are arranged between said portions of the first and second conductors, and in that the third conductor for balancing the current is located between said portions of the first and second conductors.

3. Device according to claim 1, wherein the third conductor is arranged so that when the short-circuiting wedges are inserted into the housings, the current flowing in said third conductor flows in the opposite direction to that of current flow in said portion of the first conductor, or the second conductor respectively, to which the third conductor is connected.

4. Device according to claim 1, wherein the first conductor is a conductor to bypass the first cell.

5. Device according to claim 1, wherein the second conductor is a conductor to bypass the second cell.

6. Device according to claim 1, characterized in that the device comprises an insulating element arranged between the third conductor and said portion of the first conductor, or second conductor respectively, to which the third conductor is connected.

7. Device according to claim 1, characterized in that the pots of the sequence of cells are substantially rectangular and arranged perpendicular to the axis of cell alignment, said portions of the first and second conductors extending substantially parallel to long sides of the pots.

8. Device according to claim 1, wherein at least one housing for receiving a short-circuiting wedge has a tilted face, viewed in a plane orthogonal to a direction in which said portions of the first and second conductors extend, so that the housing has a convergent shape in a direction of insertion of a wedge.

9. Device according to claim 1, characterized in that the device includes, in each half-space separated by a vertical plane through the axis of cell alignment, a set of two housings for receiving a wedge, located near a side edge of the pot, and at least one additional housing for receiving a wedge located between said set of two housings and the axis of cell alignment.

10. Method for bypassing a first cell belonging to a series of cells for the production of aluminum using the Hall-Héroult process, the series of cells being aligned along an axis, each cell comprising an electrolytic pot containing a cathode assembly and an anode frame bearing anodes, through an electrical connection device comprising an array of electrical conductors connecting in series the cathode assembly of the first cell to the anode frame of the second cell located immediately downstream, the array of electrical conductors comprising at least:

a first conductor connected to the cathode assembly of the first cell and to the anode frame of the second cell, said first conductor having a portion located between the first and second cells in which the current flows toward the alignment axis of the sequence of cells;

a second conductor connected to the cathode assembly of the second cell and the anode frame of a third cell immediately downstream of the second cell, said second conductor having a portion located between the first and second cells in which current flows away from the alignment axis of the sequence of cells, said portions of the first and second conductors being substantially parallel to each other; and at least two housings to receive a short-circuiting wedge, characterized in that the array of conductors further comprises a third conductor for current balancing which extends substantially parallel to said portions, said third conductor being electrically connected to said portion of the first conductor or second conductor, the two housings for receiving a wedge being arranged between said third conductor and said portion of the second conductor, or first conductor respectively, wherein the method comprises inserting a first and a second wedge into the housings for receiving a short-circuiting wedge arranged between said third conductor and said portion of the second conductor, or the first conductor respectively.

* * * * *